US005455133A

United States Patent [19]

Gorog et al.

[11] Patent Number: 5,455,133

[45] Date of Patent: Oct. 3, 1995

[54] METHOD OF MANUFACTURING A SCREEN ASSEMBLY HAVING A PLANARIZING LAYER

[75] Inventors: Istvan Gorog, Lancaster; Peter M. Ritt, E. Petersburg, both of Pa.

[73] Assignee: Thomson Consumer Electronics, Inc., Indianapolis, Ind.

[21] Appl. No.: 297,744

[22] Filed: Aug. 30, 1994

[51] Int. Cl.[6] ..... G03C 5/00

[52] U.S. Cl. ..... 430/23; 430/25; 430/26; 430/27; 430/28

[58] Field of Search ..... 430/23, 25, 26, 430/27, 28

[56] References Cited

U.S. PATENT DOCUMENTS

| | | | |
|---|---|---|---|
| 3,558,310 | 1/1971 | Mayaud | 96/36.1 |
| 4,921,767 | 5/1990 | Datta et al. | 430/23 |
| 5,083,959 | 1/1992 | Datta et al. | 445/52 |
| 5,229,234 | 7/1993 | Riddle et al. | 430/28 |
| 5,240,801 | 8/1993 | Hayashi et al. | 430/59 |

*Primary Examiner*—S. Rosasco

*Attorney, Agent, or Firm*—Joseph S. Tripoli; Dennis H. Irlbeck; Vincent J. Coughlin, Jr.

[57] ABSTRACT

In accordance with the present invention, a method of electrophotographically manufacturing a luminescent screen assembly on an interior surface of a faceplate panel 12 of a color CRT 10 comprises the steps of coating the interior surface of the panel with a volatilizable, organic conductive material to form an organic conductive (OC) layer 32, and overcoating the OC layer 32 with a volatilizable, photoconductive material to form an organic photoconductive (OPC) layer 34. Then, a substantially uniform voltage is established on the OPC layer 34, and selected areas of the OPC layer 34 are exposed to visible light to affect the voltage thereon, without affecting the voltage on the unexposed area of the OPC layer 34. Next, triboelectrically charged, light-absorbing screen structure material is deposited onto the unexposed area of the OPC layer 34 to form a substantially continuous matrix 23 of light-absorbing material having open areas therein. The present method is an improvement over prior methods in that the present method includes the additional steps of forming a planarizing layer 35, 135 on the OPC layer 34; overcoating the planarizing layer 35, 135 with a second coating of the volatilizable, organic conductive material to form a second OC layer 132, and then overcoating the second OC layer 132 with a second coating of the volatilizable, organic photoconductive material to form a second OPC layer 134. The phosphor materials are deposited onto a suitable charged and exposed second OPC layer 134 so that the phosphors completely overlie the openings in the matrix 23 and overlap at least a portion of the matrix adjacent to the openings.

6 Claims, 3 Drawing Sheets

Fig. 1
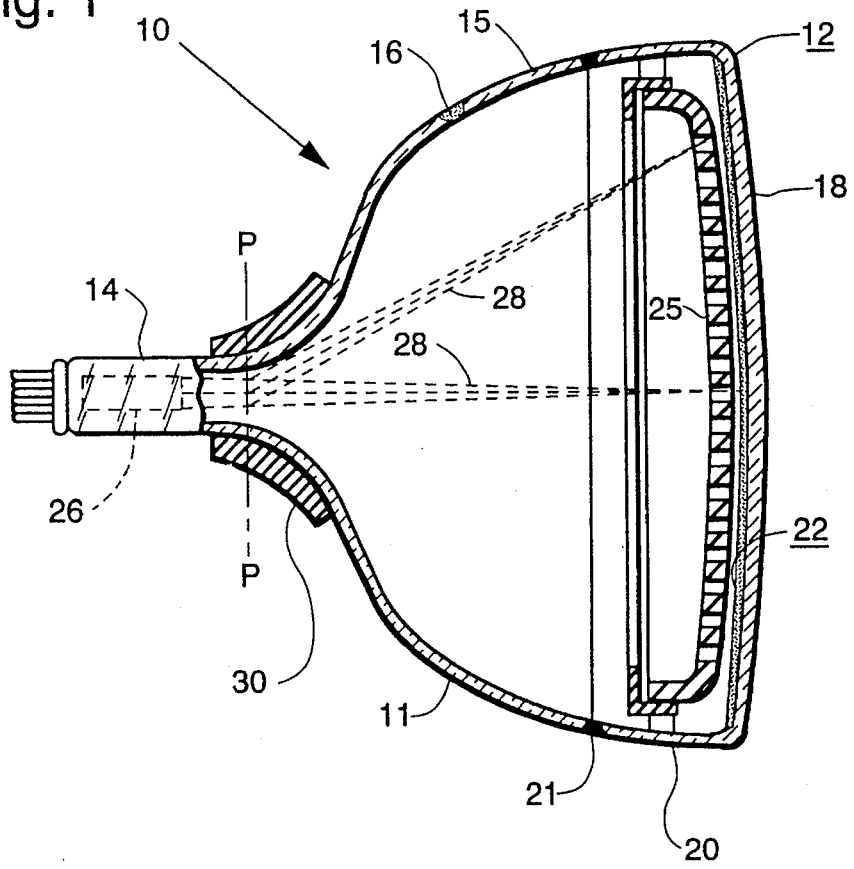
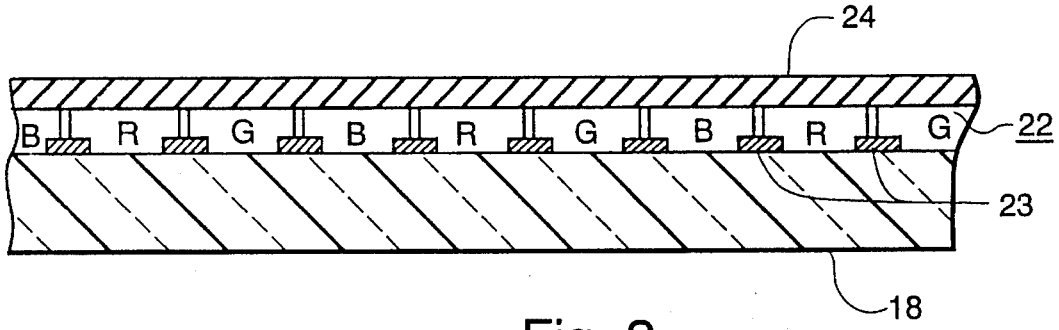
Fig. 2

METHOD OF MANUFACTURING A SCREEN ASSEMBLY HAVING A PLANARIZING LAYER

The present invention relates to a method of manufacturing a luminescent screen assembly for a cathode-ray tube (CRT) by the electrophotographic screening (EPS) process, using triboelectrically charged screen structure materials, and more particularly, to a method for eliminating the misregister of the subsequently deposited phosphors caused by the charging properties of a previously deposited EPS matrix, and for forming a "planarizing" layer that provides a smooth surface for the screen assembly.

BACKGROUND OF THE INVENTION

In the electrophotographic screening (EPS) process described in U.S. Pat. Nos. 4,921,767, issued to Datta et al., on May 1, 1990 and in 5,229,234, issued to Riddle et al. on Jul. 20, 1993, dry-powdered, triboelectrically charged, color-emitting phosphors are deposited, serially, on an electrostatically chargeable photoreceptor having a dry-powdered, triboelectrically charged, light-absorbing matrix thereon. The photoreceptor comprises an organic photoconductive (OPC) layer overlying, preferably, an organic conductive (OC) layer, both of which are deposited, serially, on an interior surface of a CRT faceplate panel. Initially, the OPC layer of the photoreceptor is electrostatically charged to a positive potential, using a suitable corona discharge apparatus of the type described in U.S. Pat. No. 5,083,959, issued to Datta et al. on Jan. 28, 1992. Then, selected areas of the photoreceptor are exposed to visible light to discharge those areas, without affecting the charge on the unexposed area. Next, triboelectrically negatively charged, light-absorbing material is deposited, by direct development, onto the charged, unexposed area of the photoreceptor to form a substantially continuous pattern of light-absorbing material, hereinafter called a matrix, having open areas therein. In order to achieve sufficient optical density, or opacity, of the EPS-deposited matrix, it is necessary to build-up a sufficient amount of light-absorbing material. This, however, results in a matrix having a relatively rough surface. The photoreceptor and the matrix are recharged by the corona discharged apparatus to impart an electrostatic charge thereon. It is desirable that the charge on the photoreceptor be of the same magnitude as that on the previously deposited matrix; however, it has been determined that the photoreceptor and the matrix do not necessarily charge to the same potential. In fact, the charge acceptance of the matrix is different from the charge acceptance of the photoreceptor. Consequently, when different selected areas of the photoreceptor are exposed to visible light to discharge those areas, to facilitate reversal development with triboelectrically positively charged color-emitting phosphor materials, the matrix retains a positive charge of a different magnitude than the positive charge on the unexposed area of the photoreceptor. This charge difference influences the deposition of the positively charged color-emitting phosphor materials, causing the phosphors to be more strongly repelled by the charge on the matrix, than by the charge on the unexposed area of the photoreceptor. This stronger repelling effect of the matrix causes the color-emitting phosphors to be slightly displaced from their desired locations on the photoreceptor. The repelling effect of the matrix is small, nevertheless, the effect is sufficient to narrow the width of the color-emitting phosphor lines so that the lines do not contact and overlap the edges of the matrix. Thus, slight gaps occur between the phosphor lines and the surrounding matrix. These gaps are unacceptable because they reduce the brightness of the phosphor in each picture element. Furthermore, the gaps are visible when the screen assembly is aluminized to provide a reflective backing and anode contact to the screen assembly.

One method of reducing the repulsive effect of the EPS-deposited matrix is described in co-pending U.S. patent application Ser. No. 250,231, filed on May 27, 1994 by Ritt et al., and entitled, METHOD OF ELECTROPHOTOGRAPHIC PHOSPHOR DEPOSITION. In that application, rather than using an EPS-deposited matrix, a conventional wet slurry matrix is formed by the process described in U.S. Pat. No. 3,558,310, issued to Mayaud on Jan. 26, 1971. The conventional matrix is formed directly on the interior surface of the faceplate. The conventional matrix is thin and smooth, and has the desired opacity so that the OC and OPC layers can be deposited directly thereon. Additionally, the overlying OC and OPC layers eliminate the electrostatic interaction between the matrix and the EPS-deposited phosphors. However, to improve the efficiency of the screening operation, and to have an entirely dry screening process, it is desirable also to deposit the matrix by the EPS process, but without the above-described deleterious electrostatic interaction.

A need thus exists to electrically isolate the prior EPS-deposited matrix so that the matrix is not electrostatically charged during the EPS deposition of the three color-emitting phosphors, and to form a planarizing layer that provides a smooth surface for the subsequent processing of the screen assembly, so that the phosphors are properly registered with respect to the matrix.

SUMMARY OF THE INVENTION

In accordance with the present invention, a method of electrophotographically manufacturing a luminescent screen assembly on an interior surface of a faceplate panel for a color CRT comprises the steps of coating the interior surface of the panel with a volatilizable, organic conductive material to form an organic conductive (OC) layer, and overcoating the OC layer with a volatilizable, photoconductive material to form an organic photoconductive (OPC) layer. Then, a substantially uniform voltage is established on the OPC layer, and selected areas of the OPC layer are exposed to visible light to affect the voltage thereon, without affecting the voltage on the unexposed area of the OPC layer. Next, triboelectrically charged, light-absorbing screen structure material is deposited onto the unexposed area of the OPC layer, to form a substantially continuous matrix of light-absorbing material having open areas therein. The present method is an improvement over prior methods in that the present method includes the additional steps of: forming a planarizing layer on the OPC layer; overcoating the planarizing layer with a second coating of the volatilizable, organic conductive material to form a second OC layer; and, then, overcoating the OC layer with a second coating of the volatilizable, organic photoconductive material to form a second OPC layer.

BRIEF DESCRIPTION OF THE DRAWINGS

The invention will now be described in greater detail, with relation to the accompanying drawings, in which:

FIG. 1 is a plan view, partially in axial section, of a color CRT made according to the present invention;

FIG. 2 is a section as a screen assembly of the tube shown in FIG. 1;

DETAILED DESCRIPTION OF THE PREFERRED EMBODIMENTS

Figure 3:
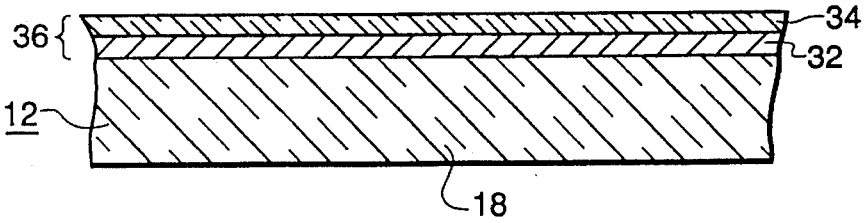
Fig. 3 PRIOR ART
FIGS. 3–8 show a section of a faceplate panel during several conventional steps in the EPS process.

FIG. 1 shows a color CRT 10 having a glass envelope 11 comprising a rectangular faceplate panel 12 and a tubular neck 14 connected by a rectangular funnel 15. The funnel 15 has an internal conductive coating (not shown) that contacts an anode button 16 and extends into the neck 14. The panel 12 comprises a viewing faceplate or substrate 18 and a peripheral flange or sidewall 20, which is sealed to the funnel 15 by a glass frit 21. A three color phosphor screen 22 is carried on the inner surface of the faceplate 18. The screen 22, shown in FIG. 2, is a line screen which includes a multiplicity of screen elements comprised of red-emitting, green-emitting and blue-emitting phosphor stripes R, G, and B, respectively, arranged in color groups or picture elements of three stripes or triads, in a cyclic order. The stripes extend in a direction which is generally normal to the plane in which the electron beams are generated. In the normal viewing position of the embodiment, the phosphor stripes extend in the vertical direction. Preferably, at least portions of the phosphor stripes overlap a relatively thin, light absorptive matrix 23, as is known in the art. A dot screen also may be formed by the novel process. A thin conductive layer 24, preferably of aluminum, overlies the screen 22 and provides means for applying a uniform potential to the screen, as well as for reflecting light, emitted from the phosphor elements, through the faceplate 18. The screen 22 and the overlying aluminum layer 24 comprise a screen assembly. A multi-apertured color selection electrode or shadow mask 25 is removably mounted, by conventional means, in predetermined spaced relation to the screen assembly.

An electron gun 26, shown schematically by the dashed lines in FIG. 1, is centrally mounted within the neck 14, to generate and direct three electron beams 28 along convergent paths, through the apertures in the mask 25, to the screen 22. The electron gun is conventional and may be any suitable gun known in the art.

The tube 10 is designed to be used with an external magnetic deflection yoke, such as yoke 30, located in the region of the funnel-to-neck junction. When activated, the yoke 30 subjects the three beams 28 to magnetic fields which cause the beams to scan horizontally and vertically, in a rectangular raster, over the screen 22. The initial plane of deflection. (at zero deflection) is shown by the line P - P in FIG. 1, at about the middle of the yoke 30. For simplicity, the actual curvatures of the deflection beam paths, in the deflection zone, are not shown.

The screen is manufactured by the EPS process that is described in U.S. Pat. No. 4,921,767. Portions of that process are shown in FIGS. 3 through 8. Initially, the panel 12 is prepared for the deposition of a light-absorbing matrix 23 by washing the panel with a caustic solution, rinsing it in water, etching it with buffered hydrofluoric acid and rinsing it again with water, as is known in the art. Then, the interior surface of the viewing area 18 of the faceplate panel 12 is coated with a volatilizable, organic conductive material to form an organic conductive (OC) layer 32 which provides an electrode for an overlying, volatilizable, organic photoconductive (OPC) layer 34. The OC layer 32 and the OPC layer 34, in combination, form a photoreceptor 36. The faceplate structure having the photoreceptor 36 comprising the OC layer 32 with the OPC layer 34 thereon is shown in FIG. 3. Suitable materials for the OC layer 32 include certain quaternary ammonium polyelectrolytes recited in U.S. Pat. No. 5,370,952, issued to Datta et al, on Dec. 6, 1994. The OPC layer 34 is formed of a suitable resin, an electron donor material, an electron acceptor material, a surfactant and an organic solvent, which provide a solution that is overcoated onto the OC layer 32. Examples of suitable materials used to form the OPC layer 34 are described in the co-pending U.S. patent application Ser. No. 168,486, filed on Dec. 22, 1993, by Datta et al.

Figure 4:
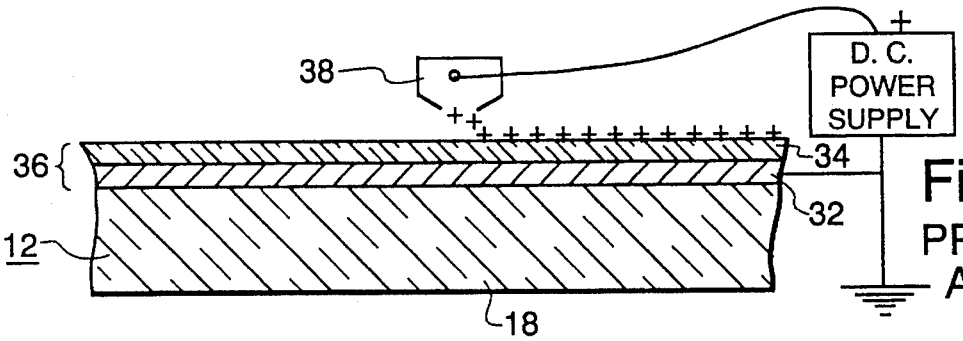
Fig. 4 PRIOR ART
Figure 5:
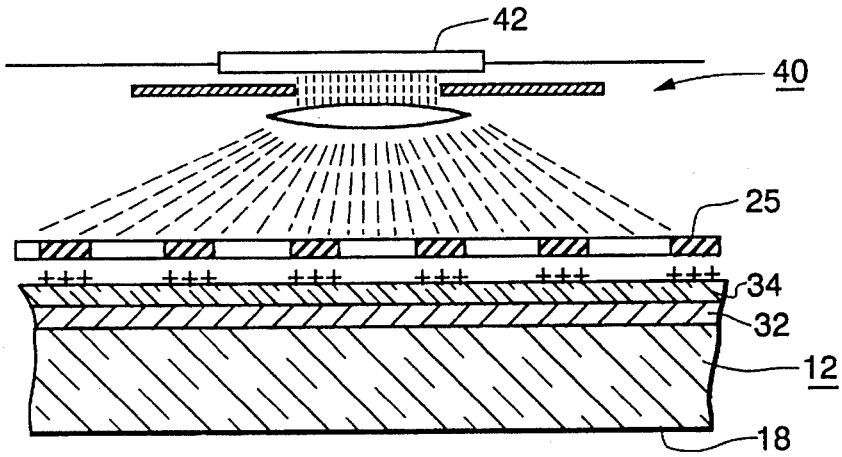
Fig. 5 PRIOR ART
Figure 6:
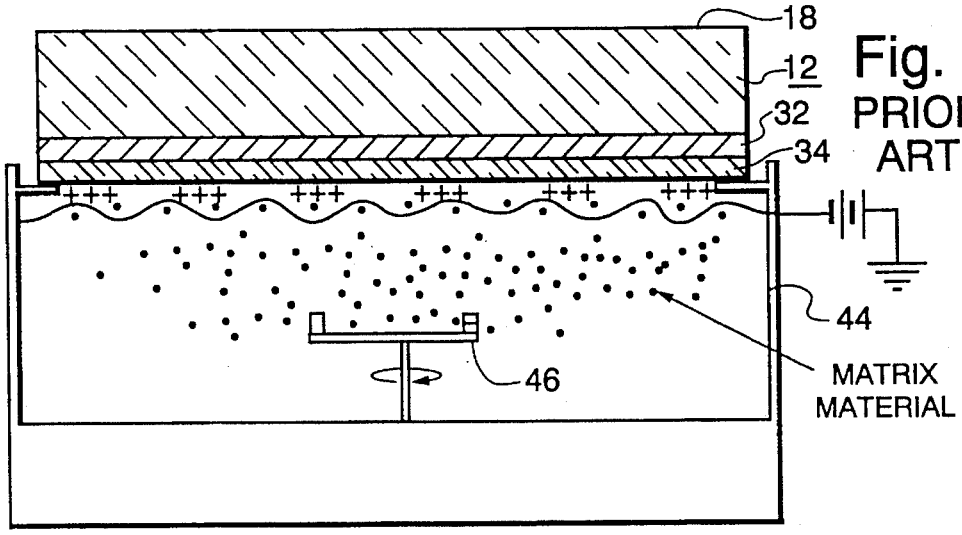
Fig. 6 PRIOR ART

In order to form the matrix 23 by the EPS process, the OPC layer 34 is electrostatically charged to a suitable potential, within the range of approximately +200 to +700 volts, using a corona discharge device 38, of the type shown schematically in FIG. 4 and described in U.S. Pat. No. 5,083,959. Then, the shadow mask 25 is inserted into the faceplate panel 12 and the panel is placed onto a three-in-one lighthouse, shown schematically in FIG. 5, as device 40, that exposes the OPC layer 34 to visible light from a light source 42 which projects light through the openings in the shadow mask. The exposure is repeated two more times with the light source located to simulate the paths of the three electron beams from the electron gun 26 of the tube 10. The light discharges the exposed areas of the OPC layer 34 where phosphor materials subsequently will be deposited, but leaves a positive charge on the unexposed area of the OPC layer 34. After the third exposure, the panel is removed from the lighthouse and the shadow mask is removed from the panel.

Figure 7:
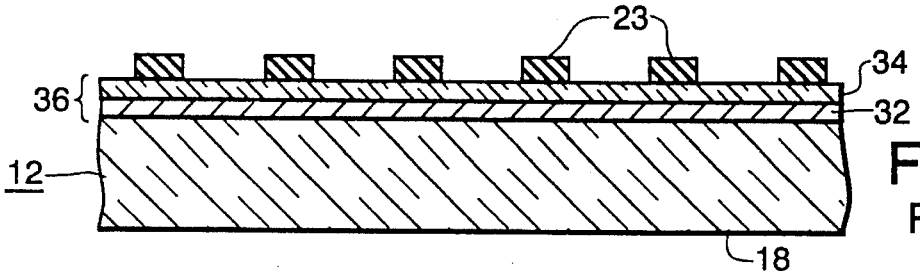
Fig. 7 PRIOR ART
Figure 8:
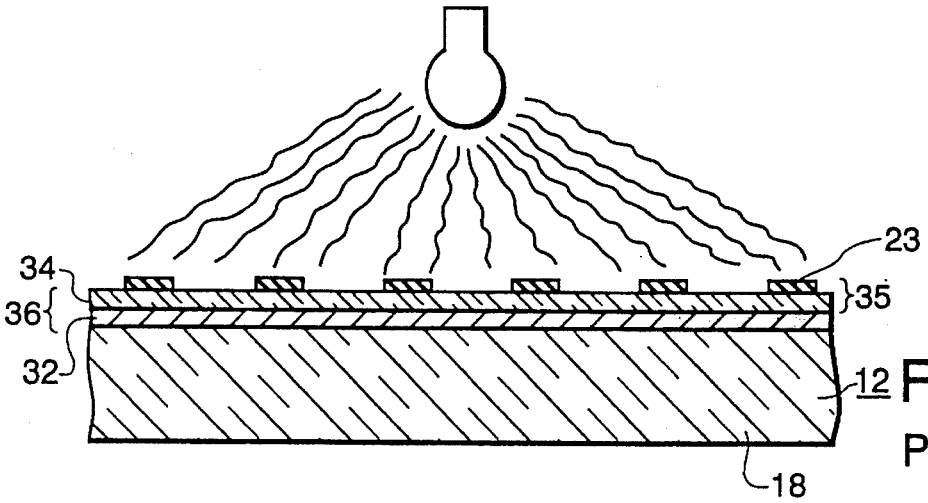
Fig. 8 PRIOR ART

The positively charged area of the OPC layer 34 is directly developed by depositing thereon triboelectrically negatively charged particles of light-absorbing material from a developer 44 of the type described in copending U.S. patent application Ser. No. 132,263, filed on Oct. 6, 1993, by Riddle et al. Suitable light-absorbing material generally contains a black pigment which is stable at a tube processing temperature of 450° C. Black pigments suitable for use in making the light-absorbing material include: iron manganese oxide; iron cobalt oxide; zinc iron sulfide; and insulating carbon black. The light-absorbing material is prepared by melt-blending the pigment, a polymer and a suitable charge control agent that controls the magnitude of the triboelectric charge imparted to the material, as described in above-referenced U.S. Pat. No. 4,921,767. A triboelectric gun 46, within the developer 44 provides a negative charge to the light-absorbing matrix particles. The negatively charged light-absorbing particles of matrix material are not attracted to the discharged areas of the OPC layer 34, but are attracted to the positively charge area surrounding the discharged areas, thereby forming openings or windows in the otherwise substantially continuous matrix, which the light-emitting phosphors subsequently will overlie. As described in the above-cited U.S. Pat. No. 5,229,234, a second deposition of matrix material may be made to increase the opacity of the matrix. The matrix 23, after development, is shown in FIG. 7. For a faceplate panel having a diagonal dimension of 51 cm (20 inches), the window openings formed in the matrix have a width of about 0.13 to 0.18 mm, and the matrix lines have a width of about 0.1 to 0.15 mm. As shown in FIG. 8 and described in the above-referenced U.S. Pat. No. 4,921,767, the light-absorbing material of the matrix 23 is fused to the underlying OPC layer 34 to prevent movement of the material during subsequent processing.

In the prior EPS process, described in U.S. Pat. No. 4,921,767, the matrix-coated faceplate panel is uniformly recharged to a positive potential, re-exposed by passing visible light through the apertures in the shadow mask to form a charge image, and developed with color-emitting phosphors. However, as described above, the matrix 23, in the prior process, acquires an electrostatic potential, during the recharging step, that is different from, and more positive than, the electrostatic potential acquired .by the OPC layer 34. The higher positive voltage on the matrix 23 repels the triboelectrically positively charged phosphor particles so that the phosphor particles do not completely fill the openings in the matrix, but leave small gaps, which are objectionable.

Figure 9:
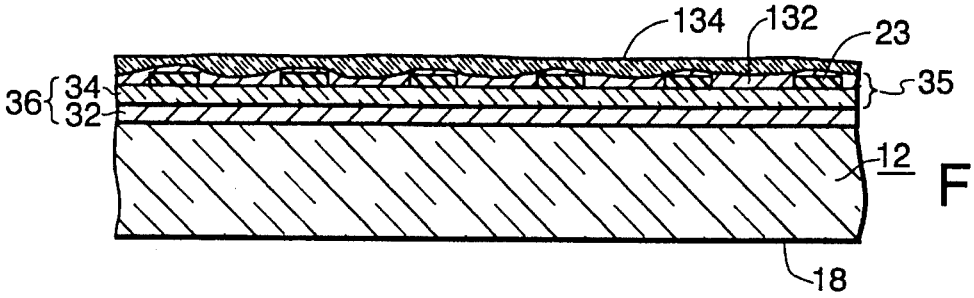
FIG. 9 is a section of the faceplate panel according to one embodiment of the novel process.

In order to eliminate these gaps, the matrix 23 must be electrostatically isolated from the subsequently deposited phosphors. This can be achieved by forming a planarizing layer 35 on the OPC layer 34, and then covering the planarizing layer 35 with a second OC layer 132 and a second OPC layer 134. In the first embodiment of the present method, shown in FIG. 9, the planarizing layer 35 is not a separate layer, but is formed by the above-described fusing of the matrix 23 to the OPC layer 34. This is accomplished by melting the polymer coating on the light-absorbing matrix material, or by causing the matrix material to be absorbed into the OPC layer 34 by the fusing operation. Then, the planarized layer 35 is overcoated with a second coating of the same volatilizable, organic conductive coating material, used for OC layer 32, to form a second OC layer 132. The OC layer 132 is then overcoated with the same volatilizable, organic photoconductive coating material, used to form OPC layer 34, to form a second OPC layer 134. This structure provides sufficient electrical isolation of the EPS-deposited matrix 23, so that the matrix will not influence the charge on the second OPC layer 134, during the phosphor deposition described below.

Figure 10:
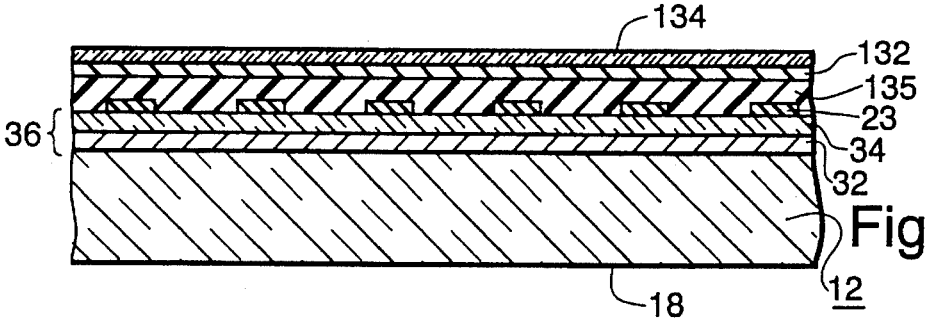
FIG. 10 is a section of the faceplate panel made according to a second embodiment of the novel process.

A second embodiment of the present method is shown in FIG. 10. The second embodiment is especially useful where the EPS-deposited matrix 23 has been built-up to provide the required opacity and has a rough surface that prohibits direct coating of a continuous OC layer. Then, a separate planarizing layer 135 is provided over the matrix and the OPC layer 34 by applying a filming emulsion of the type marketed under the brand name RHOPLEX B-74, by the ROHM and HAAS Co., Philadelphia, Pa. The filming emulsion contains a volatilizable resin that can be removed by baking the screen at a suitable temperature. Alter the planarizing layer 135 is formed, the above-described second OC layer 132 is overcoated thereon, and then, the OPC layer 134 is overcoated onto the OC layer 132. The planarizing layer 135 provides a smooth and reasonably level surface on which to form the second OC layer 132 and the second OPC layer 134 of the screen assembly, and permits correlation, or register, between the matrix 23 and the subsequently deposited color-emitting phosphors. A possible drawback of the second embodiment is that an additional quantity of organic filming material is added to the screen structure and must be removed during the screen bake step.

Further processing of the of the screen is similar to the prior EPS practice. The second OPC layer 134 is uniformly electrostatically charged using the corona discharge device, described in U.S. Pat. No. 5,083,959, which charges the second OPC layer 134 to a voltage within the range of approximately +200 to +700 volts. The shadow mask 25 is then inserted into the panel 12 and the positively charged second OPC layer 134 is exposed, through the shadow mask 25, to light from a xenon flash lamp, or other light source of sufficient intensity, such as a mercury arc, disposed within the lighthouse (not shown). The light which passes through the apertures in the shadow mask 25 at an angle identical to that of one of the electron beams from the electron gun of the tube, discharges the illuminated areas on the second OPC layer 134 on which it is incident. The shadow mask is removed from the panel 12 and the panel is placed onto a first phosphor developer (also not shown), but described in the above-referenced co-pending U.S. patent application Ser. No. 132,263. The first color-emitting phosphor material is positively triboelectrical charged within the developer and directed toward the second OPC layer 134. The positively charged first color-emitting phosphor material is repelled by the positively charged areas on the second OPC layer 134 and deposited onto the discharged areas thereof by the process known in the art as "reversal" development. In reversal development, triboelectrically charged particles of screen structure material are repelled by similarly charged areas of the OPC layer 134 and deposited onto the discharged areas. The size of each of lines of the first color-emitting phosphor is slightly larger than the size of the openings in the matrix to provide complete coverage of each opening, and a slight overlap of the light-absorbing matrix material surrounding the openings. The panel 12 is then recharged using the above-described corona discharge apparatus. A positive voltage is established on the second OPC layer 134 and on the first color-emitting phosphor material deposited thereon. The light exposure and phosphor development steps are repeated for each of the two remaining color-emitting phosphors, with the light position within the lighthouse, for each exposure, being in accordance with the method described in the above-referenced, co-pending U.S. patent application Ser. No. 250,231. The size of each of the lines of the other two color-emitting phosphor on the second OPC layer 134 also is larger than the size of the matrix openings, to ensure that no gaps occur and that a slight overlap of the light-absorbing matrix material surrounding the openings is provided. The three light-emitting phosphors are fixed to the second OPC layer 134 in the manner described in co-pending U.S. patent application Ser. No. 297,740, filed on Aug. 30, 1994 by Ritt et al. The screen structure is then filmed and aluminized to form the luminescent screen assembly. Due to the high quantity of organic materials used in the manufacturing of the screen assembly, boric acid or ammonium oxalate is sprayed onto the filmed screen structure before aluminizing, as is known in the art, to provide small openings in the aluminum layer that permit the volatilized organics to escape without causing blisters in the aluminum layer. The screen assembly is baked at a temperature of about 425° C. for about 30 minutes to drive off the volatilizable constituents of the screen assembly.

What is claimed is:

1. In a method of electrophotographically manufacturing a luminescent screen assembly on an interior surface of a faceplate panel for a color CRT, comprising the steps of:

coating said interior surface of said panel with a volatilizable, organic conductive material to form a first organic conductive (OC) layer;

overcoating said first OC layer with a volatilizable photoconductive material to form a first organic photoconductive (OPC) layer;

establishing a substantially uniform electrostatic voltage on said first OPC layer;

exposing selected areas of said first OPC layer to visible light to affect the voltage thereon, without affecting the voltage on the unexposed area of said first OPC layer;

depositing a triboelectrically charged, light-absorbing screen structure material onto the unexposed area of said first OPC layer to form a substantially continuous matrix of light-absorbing material having open areas therein; wherein the improvement comprises:

(a) forming a planarizing layer;

(b) overcoating said planarizing layer with a second coating of said volatilizable, organic conductive material to form a second OC layer; and (c) overcoating said second OC layer with a second coating of said volatilizable, organic photoconductive material to form a second OPC layer.

2. The method as described in claim 1, wherein said planarizing layer is formed by fusing said light-absorbing material to said first OPC layer.

3. The method as described in claim 1, wherein said planarizing layer is formed by applying a suitable film which overlies said first OPC layer and said light-absorbing matrix material.

4. The method as described in claim 1, further including the steps of:

(d) re-establishing a substantially uniform electrostatic voltage on said second OPC layer;

(e) exposing selected areas of said second OPC layer to visible light to affect the voltage thereon;

(f) depositing a triboelectrically charged first color-emitting phosphor onto said exposed, selected areas of said second OPC layer so that said first color-emitting phosphor overlies said open areas in said matrix corresponding to the location of the first color, and at least a portion of said light-absorbing material surrounding said open areas;

(g) recharging the unexposed area of said second OPC layer and said first color-emitting phosphor to reestablish an electrostatic voltage thereon;

(h) exposing selected areas of said second OPC layer to visible light from a light source to affect the voltage thereon, while leaving the voltages on the unexposed area of said second OPC layer and said first color-emitting phosphor unaffected; and (i) depositing a triboelectrically charged second color-emitting phosphor onto said exposed, selected areas of said second OPC layer so that said second color-emitting phosphor overlies said open areas in said matrix corresponding to the second color, and at least a portion of said light-absorbing material surrounding said open area.

5. The method as described in claim 4, further including the steps of:

(j) recharging the exposed area of said second OPC layer and said first and second color-emitting phosphors to re-establish an electrostatic voltage thereon;

(k) exposing selected areas of said second OPC layer to visible light from said light source to affect the voltage thereon, while leaving the voltages on the unexposed area of said second OPC layer and said first and said second color-emitting phosphor unaffected; and (l) depositing a triboelectrically charged third color-emitting phosphor onto said exposed, selected areas of said second OPC layer so that said third color-emitting phosphor overlies the remaining open areas in said matrix and at least a portion of said light-absorbing material surrounding said open areas.

6. The method as described in claim 5, including the additional steps of:

(m) fixing said phosphors to said second OPC layer of said luminescent screen;

(n) filming the fixed screen;

(o) aluminizing the filmed screen; and (p) baking the aluminized screen to remove the volatilizable constituents therefrom to form said luminescent screen assembly.

* * * * *